United States Patent [19]

O'Brien et al.

[11] Patent Number: 4,664,314

[45] Date of Patent: May 12, 1987

[54] WHIRL SPRAY NOZZLE

[75] Inventors: Edward J. O'Brien, Barrington; Lyle Emory, Darien, both of Ill.

[73] Assignee: Spraying Systems Co., Wheaton, Ill.

[21] Appl. No.: 736,983

[22] Filed: May 22, 1985

Related U.S. Application Data

[63] Continuation of Ser. No. 432,185, Oct. 1, 1982, abandoned.

[51] Int. Cl.[4] ..... B05B 1/34

[52] U.S. Cl. ..... 239/469

[58] Field of Search ..... 239/466, 468, 469, 471, 239/491, 492

[56] References Cited

U.S. PATENT DOCUMENTS

| | | | |
|---|---|---|---|
| 443,734 | 12/1890 | Wilgus | 239/468 |
| 501,178 | 7/1893 | Bourdil | 239/469 |
| 683,646 | 10/1901 | Gibbs | 239/469 |
| 920,864 | 5/1909 | Gorrell | 239/469 |
| 1,189,068 | 6/1916 | Davis | 239/469 |
| 1,465,580 | 8/1923 | Findlay | 239/469 |
| 1,517,598 | 12/1924 | Stevenson | 239/468 |
| 2,247,897 | 7/1941 | Wahlin | 239/469 |
| 2,358,177 | 9/1944 | Madison | 239/469 |
| 2,499,084 | 2/1950 | Bahnson | 239/469 |
| 2,659,631 | 11/1953 | Wilmes | 239/468 |
| 2,815,248 | 12/1957 | O'Brien | 239/468 |
| 3,198,214 | 8/1965 | Lorenz | 138/37 |
| 3,326,473 | 8/1964 | Wahlin | 239/468 |
| 3,762,652 | 10/1973 | Huling | 239/469 |
| 4,125,226 | 11/1978 | Nieuwkamp | 239/468 |

FOREIGN PATENT DOCUMENTS

| | | | |
|---|---|---|---|
| 428954 | 7/1945 | Canada . | |
| 460534 | 10/1949 | Canada | 239/469 |
| 0000688A2 | 8/1978 | European Pat. Off. . | |
| 688 | 2/1979 | European Pat. Off. . | |
| 1291299 | 3/1962 | France . | |
| 2324986 | 4/1977 | France . | |
| 2357309 | 2/1978 | France . | |
| 269540 | 8/1933 | Italy | 239/468 |
| 120078 | 10/1918 | United Kingdom . | |
| 201608 | 7/1923 | United Kingdom | 239/469 |
| 325756 | 2/1930 | United Kingdom . | |
| 689130 | 11/1950 | United Kingdom . | |
| 655370 | 7/1951 | United Kingdom . | |
| 662547 | 12/1951 | United Kingdom . | |
| 673062 | 6/1952 | United Kingdom . | |
| 672142 | 9/1952 | United Kingdom . | |
| 839212 | 6/1960 | United Kingdom . | |

*Primary Examiner*—Andres Kashnikow
*Assistant Examiner*—Michael J. Forman
*Attorney, Agent, or Firm*—Leydig, Voit & Mayer

[57] ABSTRACT

A spray nozzle for producing a hollow conical liquid spray having a body formed with a cylindrical whirl chamber having a tangentially disposed liquid inlet passage and an orifice cap removably mountable at the end of the whirl chamber formed with a spray discharge orifice of the desired configuration. The nozzle body includes an upstanding post concentrically disposed within the whirl chamber for guiding pressurized liquid in a tangential direction about the whirl chamber, and the post has a recessed upper end for receiving the air core of whirling liquid within the chamber to retain the proper axial position of the air core and to prevent air core damage to the nozzle body.

3 Claims, 3 Drawing Figures

WHIRL SPRAY NOZZLE

This application is a continuation of application Ser. No. 432,185, filed Oct. 1, 1982, now abandoned.

DESCRIPTION OF THE INVENTION

The present invention relates generally to spray nozzles, and more particularly, to spray nozzles of the type that produce a hollow cone spray.

In such spray nozzles, a pressurized liquid stream is introduced tangentially into a cylindrical whirl chamber to impart a rapid swirling movement to the liquid, with the resulting centrifical forces producing a spray of hollow, conical or similar shape as it emerges from a discharge orifice of the nozzle. The whirling movement of the liquid creates an elongated hollow air core within the spray which extends to the bottom of the whirl chamber. The lower end or vortex of the air core can create significant wear to the bottom of the nozzle body, and in some instances bore a hole through the nozzle body in a relatively short time. While various whirl chamber designs have been proposed from minimizing air core wear in such spray nozzles, these designs often have not have been susceptible to easy manufacture by conventional techniques, such as plastic injection molding or metal machining, and sometimes have adversely affected the spray characteristics of the nozzle.

In addition to wear prevention considerations, for example, it is important to design both the inlet orifice and the whirl chamber such that the air core remains in centered axial relation to the discharge orifice in order to achieve uniform liquid distribution in the hollow spray pattern. Because of unbalanced forces resulting from the tangential introduction of liquid into the whirl chamber, there is a tendency for the lower portion of the air core in the whirl chamber to be shifted away from the axis of the discharge orifice. Moreover, even small variations in the inlet orifice or the bottom wall of the whirl chamber can effect the proper air core position, and thus, the uniformity of the spray pattern. While various approaches again have been proposed for centering the air core in the whirl chamber, such prior designs in many instances have been objectional from the standpoint of permitting excessive air core wear, as being relatively costly to produce, or not being adaptable to accommodate changes in size or capacity of the nozzle.

It is a primary object of the invention to provide a relatively simple and economically produceable whirl spray nozzle which both effectively minimizes air core wear and controls the air core position for uniform spray distribution.

Another object is to provide a whirl spray nozzle as characterized above which lends itself to easy manufacture.

A further object is to provide a whirl spray nozzle of the above kind which accommodates design variations for different nozzle inlet orifice sizes and nozzle spray capacities.

Other objects and advantages of the invention will become apparent upon reading the following detailed description and upon reference to the drawings, in which.

Figure 1:
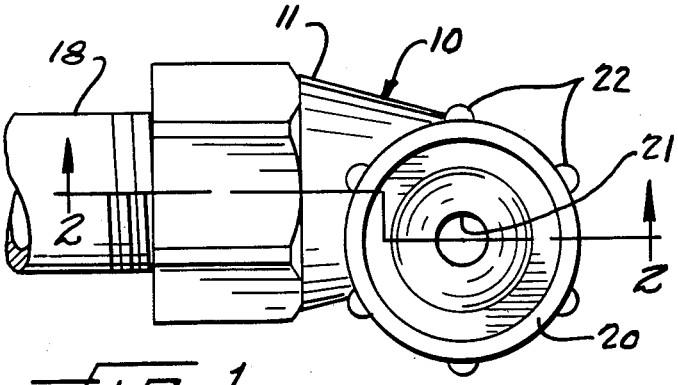
FIG. 1 is a top plan of an illustrative spray nozzle embodying the present invention.

While the invention is susceptible of various modifications and alternative constructions, a certain illustrated embodiment thereof has been shown in the drawings and will be described below in detail. It should be understood, however, that there is no intention to limit the invention to the specific form disclosed, but on the contrary, the invention is to cover all modifications, alternative constructions and equivalents falling within the spirit and scope of the invention.

Referring now more particularly to the drawings, there is shown an illustrative spray nozzle 10 embodying the present invention. The nozzle 10 includes a main body 11 formed with a cylindrical whirl chamber 12 and an inlet passage 14 extending tangentially and at a right angle to the cylindrical whirl chamber 12. The inlet passage 14 preferably communicates with a lower portion of the whirl chamber 12, entering the whirl chamber at a point slightly above a bottom wall 13 thereof. The nozzle body 11 in this instance includes an inlet connector end 15 extending to one side thereof formed with an internally threaded bore 16 in communication with the inlet passage 14 for coupling to the threaded end of a fluid supply line 18. The body 11 has an internally threaded discharge end 19 which receives the threaded end of an orifice cap 20 formed with a discharge orifice 21 that is in coaxial communication with the whirl chamber 12. The outer end of the orifice cap 20 may be formed with appropriate means, such as circumferentially spaced ribs 22, which facilitate turning of the cap for tightening and removal from the body 11.

The discharge orifice 21 of the illustrated cap 20 includes an inwardly tapered orifice section **21*a* extending upwardly from the whirl chamber 12 and into communication with a relatively short length, reduced diameter, cylindrical orifice section 21*b*. The upper face of the orifice cap 20 is formed with a downwardly and outwardly tapered portion 21*c* about the periphery of the cylindrical orifice section 21*b*. As is known in the art, the configuration of the discharge orifice 21 may vary according to the spray angle and configuration desired, and in the illustrated embodiment, the cap 20 is readily removable and replaceable by unscrewing the cap from the nozzle body 11**.

Figure 2:
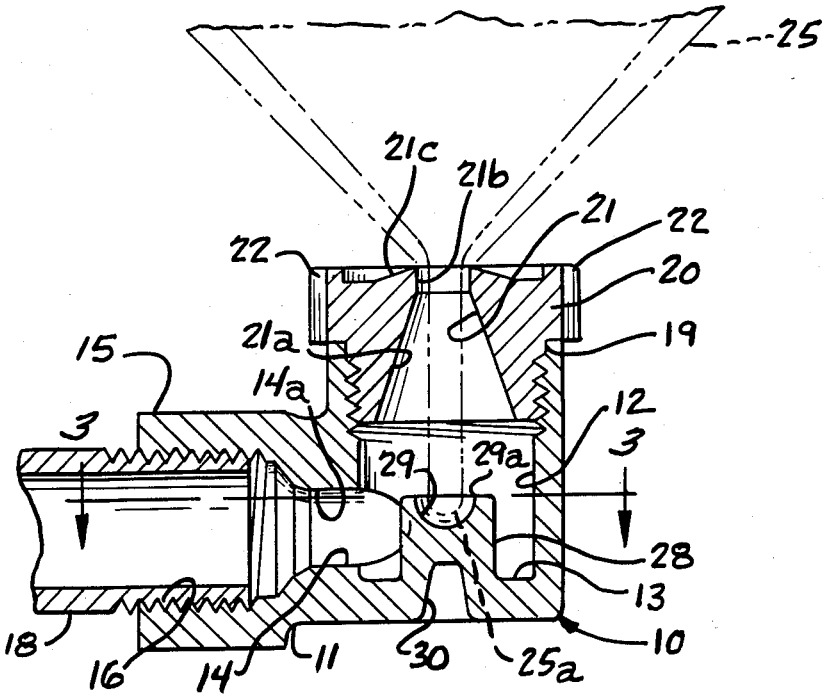
FIG. 2 is a vertical section taken in the plane of line 2—2 in FIG. 1.

Pressurized liquid introduced into the supply line 18 will tangentially enter the whirl chamber 12 through the inlet passage 14, causing a rapid swirling movement to be imparted to the liquid in the chamber. As liquid continues to be directed into the whirl chamber from the supply line, the swirling liquid in the chamber will be expelled outwardly through the discharge orifice 21 of the cap 20 in a centrally-open, rotating stream at a sufficient velocity to form a relatively thin, hollow cone spray 25, as indicated in FIG. 2. The resulting air core within the hollow cone spray pattern extends through the nozzle discharge orifice 21 and into the whirl chamber 12 terminating in a lowermost vortex **25*a*. The uniformity of volume and the direction of the spray projection, as is known in the art, is adversely affected if the axis of rotation of the liquid, and thus the air core, is varied with respect to the axis of the whirl chamber 12 and discharge orifice 21**.

Figure 3:
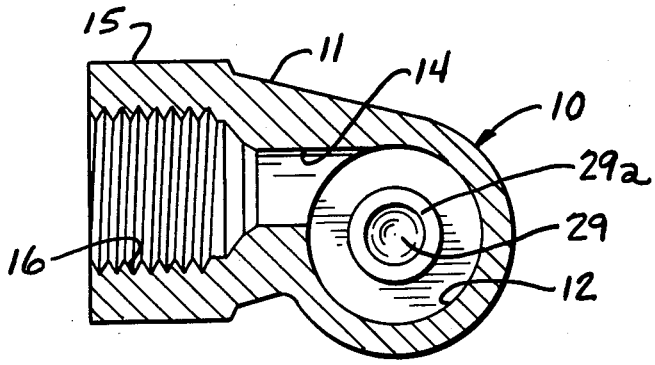
FIG. 3 is a horizontal section taken in the plane of line 3—3 in FIG. 2.

In accordance with the invention, the nozzle body has an axially disposed whirl chamber post extending upwardly from the bottom of the whirl chamber, which assists in guiding liquid introduced in the whirl chamber in the proper tangential direction and which is formed with a recessed upper end that retains the axial position of the swirling liquid within the chamber and minimizes air core wear. To this end, in the illustrated embodiment, the nozzle body 11 has an integrally formed upstanding post 28 which extends from the bottom 13 of the whirl chamber to an elevation about level with an upper periphery 14*a* of the inlet passage 14, as shown in FIG. 2, such that the post extends substantially across one side of the path of the liquid being introduced into the whirl chamber. The illustrated post 28 is approximately one-half the diameter of the whirl chamber 12, and the inlet passage 14, which may have a diameter up to one-half that of the whirl chamber, in this case is of slightly smaller size. Pressurized liquid introduced into the whirl chamber through the inlet passage 14 thereby moves about a common side of the post 28, as best seen in FIG. 3, with the post tending to assist in guiding the liquid stream in the proper direction.

In keeping with the invention, upper end of the whirl chamber post 28 is formed with a recess 29 which serves to retain the air core of the swirling liquid coaxially in the whirl chamber so as to enhance the uniformity of the spray output, while minimizing air core wear to the nozzle body 11. The illustrated recess 29 has a concave spherical shape, with an outer peripheral edge 29*a* having a circular configuration concentrically located with respect to the discharge orifice 21. While other shapes of recesses may be employed, the recess 29 preferably should have a continuously curved, uninterrupted peripheral edge 29*a*, which facilitates retention of the lowermost vortex of the air core without disrupting the whirling liquid or causing undue turbulence thereto.

In use of the nozzle of the present invention, it has been found that the recessed upstanding whirl chamber post 28 will effectively maintain the proper axial position of the air core without incurring significant air core wear. Moreover, it has been found that the basic nozzle design may be easily varied to accommodate different capacities without affecting the improved wear and spray characteristics of the nozzle. For example, it has been found that the same basic nozzle body design may be utilized with different sized inlet passages 14 and with different orifice caps 20 while retaining all of the advantages of the invention. With a standard nozzle body design having the upstanding whirl chamber post extending to an elevation about level with the upper perimeter of the inlet passage 14, or slightly above such elevation, the same body can be used for nozzles with incrementally larger or smaller inlet passages.

It will be appreciated by one skilled in the art that the nozzle body will accordingly lend itself to economical production since variable size and capacity nozzles may be produced by altering only the inlet passage. It will also be appreciated that the nozzle body can be economically manufactured by conventional techniques. While in the illustrated embodiment a plastic injected molded nozzle body 11 has been shown with an integrally formed upstanding whirl chamber post 28, it will be understood that the nozzle body could be readily machined from stock or a metal casting. Moreover, although the illustrated whirl chamber post is an integral part of the body, alternatively it could be a separate and replaceable item, fixed to the body by threadable engagement or the like.

From the foregoing, it can be seen that the whirl spray nozzle of the present invention is relatively simple and economical to produce, effectively controls air core wear and position, and is adapted to accomodate design variations for different inlet sizes and nozzle spray capacity.

What is claimed is:

1. A spray nozzle for producing a hollow conical liquid spray pattern having a central air core comprising a body formed with a whirl chamber having a circular side wall and a bottom wall, said body having an inlet passage for directing liquid in a substantially tangential direction into said circular whirl chamber, means closing the top of said chamber and defining a circular spray discharge orifice disposed coaxially with the circular side wall of said whirl chamber, a post extending upwarding from said whirl chamber bottom wall, said post have a diameter of about one half the diameter of said whirl chamber and extending upwardly to an elevation about level with the upper perimeter of said inlet passage for guiding pressurized liquid introduced into said whirl chamber from said inlet passage in proper whirling direction about the circular side wall of said whirl chamber, and said post having an upper end formed with a recess which has an uninterrupted generally circular outermost perimeter, said recess extending an appreciable depth into the post but less than ½ the diameter of said post and being in axial alignment with said discharge orifice and said annular side wall for recieving the lowermost end of the air core of the whirling liquid within said chamber for retaining the proper axial position of the air core and whirling liquid without substantial diffusion of the hollow cone spray pattern and for preventing damage to said body from said air core and whirling liquid.

2. The spray nozzle of claim 1 in which said whirl chamber post is integrally formed in said body.

3. The spray nozzle of claim 1 in which said post is formed with a concave spherical recess.

* * * * *

UNITED STATES PATENT AND TRADEMARK OFFICE

CERTIFICATE OF CORRECTION

PATENT NO. : 4,664,314

DATED : May 12, 1987

INVENTOR(S) : Edward J. O'Brien & Lyle Emory

It is certified that error appears in the above-identified patent and that said Letters Patent is hereby corrected as shown below:

On the Title Page:

Col. 1, after "Emory, Darien," insert --Daniel A. Vidusek, St. Charles,-- and on same line, delete "both" and insert --all--

Signed and Sealed this

Seventeenth Day of November, 1987

*Attest:*

DONALD J. QUIGG

*Attesting Officer*

*Commissioner of Patents and Trademarks*